US007076887B1

(12) United States Patent
Camberos

(10) Patent No.: US 7,076,887 B1
(45) Date of Patent: Jul. 18, 2006

(54) BODY DRYING APPARATUS

(76) Inventor: Jesse C. Camberos, 15579 Adelhart St., Hacienda Heights, CA (US) 91745

( * ) Notice: Subject to any disclaimer, the term of this patent is extended or adjusted under 35 U.S.C. 154(b) by 0 days.

(21) Appl. No.: 11/056,737

(22) Filed: Feb. 14, 2005

Related U.S. Application Data

(60) Provisional application No. 60/556,793, filed on Mar. 29, 2004.

(51) Int. Cl.
*F26B 25/06* (2006.01)

(52) U.S. Cl. ..... 34/90; 34/201; 34/225; 34/233

(58) Field of Classification Search ..... 34/91, 34/202, 239, 618, 201, 209, 210, 211, 225, 34/233, 90, 89
See application file for complete search history.

(56) References Cited

U.S. PATENT DOCUMENTS 3,449,838 A 6/1969 Chancellor, Jr.
3,621,199 A 11/1971 Goldstein
3,878,621 A 4/1975 Duerre
4,780,595 A 10/1988 Alban
D311,070 S 10/1990 Blevins
4,961,272 A * 10/1990 Lee ..... 34/90
5,377,424 A 1/1995 Albanes
5,651,189 A 7/1997 Coykendall et al.
5,873,179 A 2/1999 Gregory et al.
6,067,725 A * 5/2000 Moser ..... 34/223

* cited by examiner

*Primary Examiner*—Kenneth Rinehart

(57) ABSTRACT

A body drying apparatus includes a housing for dissipating heated air outwardly therefrom and is situated within a plenum having at least one rear wall abutted against an interior surface of the plenum. The housing further has a front wall including a vent formed therein and a top wall provided with an opening in fluid communication with the vent. The vent is provided with a grill for channeling the heated air. The present invention further includes a power unit and a plurality of flexible conduits for directing ambient air into the power unit and for directing the heated air out from the power unit. The power unit is electrically coupled to an external power supply source. A mechanism is included for remotely operating the power unit such that a user may toggle the apparatus between on and off modes.

15 Claims, 3 Drawing Sheets

BODY DRYING APPARATUS

CROSS REFERENCE TO RELATED APPLICATIONS

This application claims the benefit of U.S. Provisional Application No. 60/556,793 filed Mar. 29, 2004.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

TECHNICAL FIELD

This invention relates to a drying apparatus and, more particularly, to a body drying apparatus for removing externally disposed fluids from a user's body.

PRIOR ART

Electric body dryers are convenient and efficient as a replacement for towel drying. They reduce maintenance costs and improve the unsanitary conditions associated with towel drying, particularly in locker rooms, hotels, and public washrooms. Problems of towel theft are also eliminated. Body dryers used in public places can be mounted in the ceiling or on a wall to prevent vandalism and theft.

A body dryer would also be quite useful at home, particularly as a supplement to towel drying. Towel drying can be insufficient, particularly in a damp shower area, or in warm, humid weather. After a shower or bath, one is frequently left with a damp, sticky feeling which can be eliminated with a body dryer.

Most body drying systems in the prior art do not have a mechanism to activate the dryer from a remote location as may sometimes be desirable. Another aspect where conventional body driers are lacking is the fact that they are so complicated in design that they can not be conveniently mounted within a shower. Thus, an individual must step out of the shower to a different location in order to be dried.

Accordingly, a need remains for a body drying apparatus in order to overcome the above-noted shortcomings. The present invention satisfies such a need by providing an apparatus that is easy to use and provides an improved level of hygiene and comfort. Such a drying apparatus conveniently allows an individual to dry off more quickly than is otherwise possible and without inflicting skin irritation as is often the case with towels. The apparatus is also appealing to older or disabled individuals who find drying themselves with a towel a daunting task. Advantageously, the apparatus can be used on hot summer days to cool off after a warm shower, thus increasing one's comfort.

BRIEF SUMMARY OF THE INVENTION

In view of the foregoing background, it is therefore an object of the present invention to provide a body drying apparatus. These and other objects, features, and advantages of the invention are provided by an air-drying apparatus for removing externally disposed fluids from a user's body.

The system includes a vertically oriented housing for dissipating heated air outwardly therefrom and into a plenum sized and shaped for containing a user therein. Such a housing is situated within the plenum and has at least one rear wall abutted against an interior surface of the plenum. The housing further has a front wall including a vent formed therein for effectively permeating the heated air into the plenum during operating conditions and a top wall provided with an opening in fluid communication with the vent. Such a vent extends along a longitudinal length of the front wall and is provided with a grill channeling the heated air in a selected direction.

A power unit and a plurality of flexible conduits direct ambient air into the power unit and direct the heated air out from the power unit into the housing via the opening respectively. Such a power unit is electrically coupled to an external power supply source. The power unit and the conduits are positioned exterior of the plenum.

The power unit preferably includes a casing having an inlet and outlet oppositely formed therein. Such an inlet is in fluid communication with one of the conduits for effectively introducing the ambient air into the casing. The outlet is in fluid communication with another one of the conduits for advantageously dissipating the heated air away from the casing. The power unit further includes a motor including a drive shaft extending outwardly therefrom. A support bracket effectively maintains the motor at a substantially stable position during operating conditions and an air blower is operably connected to the drive shaft and spaced medially of the inlet and the outlet respectively. Such a blower is rotatable in sync with the drive shaft for directing a selected volume of the ambient air towards the outlet.

A plurality of heating elements are positioned downstream of the blower for advantageously converting the ambient air into the heated air as the ambient air is passed therethrough. Such heating coils are disposed adjacent the outlet such that the heated air can be effectively directed into the housing via another conduit. The power unit further includes a pair of spaced brackets having a predetermined spatial relationship for vertically juxtaposing the heating coils. Such heating coils have opposed end portions positioned along a substantially horizontal axis and connected to the brackets.

A mechanism is included for remotely operating the power unit such that a user may conveniently toggle the apparatus between on and off modes while situated in an aqueous environment adjacent to the housing. Such a remote operating mechanism includes a portable hand-operable control panel and a sensor disposed within the housing for receiving an operating signal generated by a user input at the control panel. The housing may further include a pocket for supporting the control panel therein to thereby advantageously reduce the likelihood of misplacing the control panel during non-operating conditions.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

Figure 1:
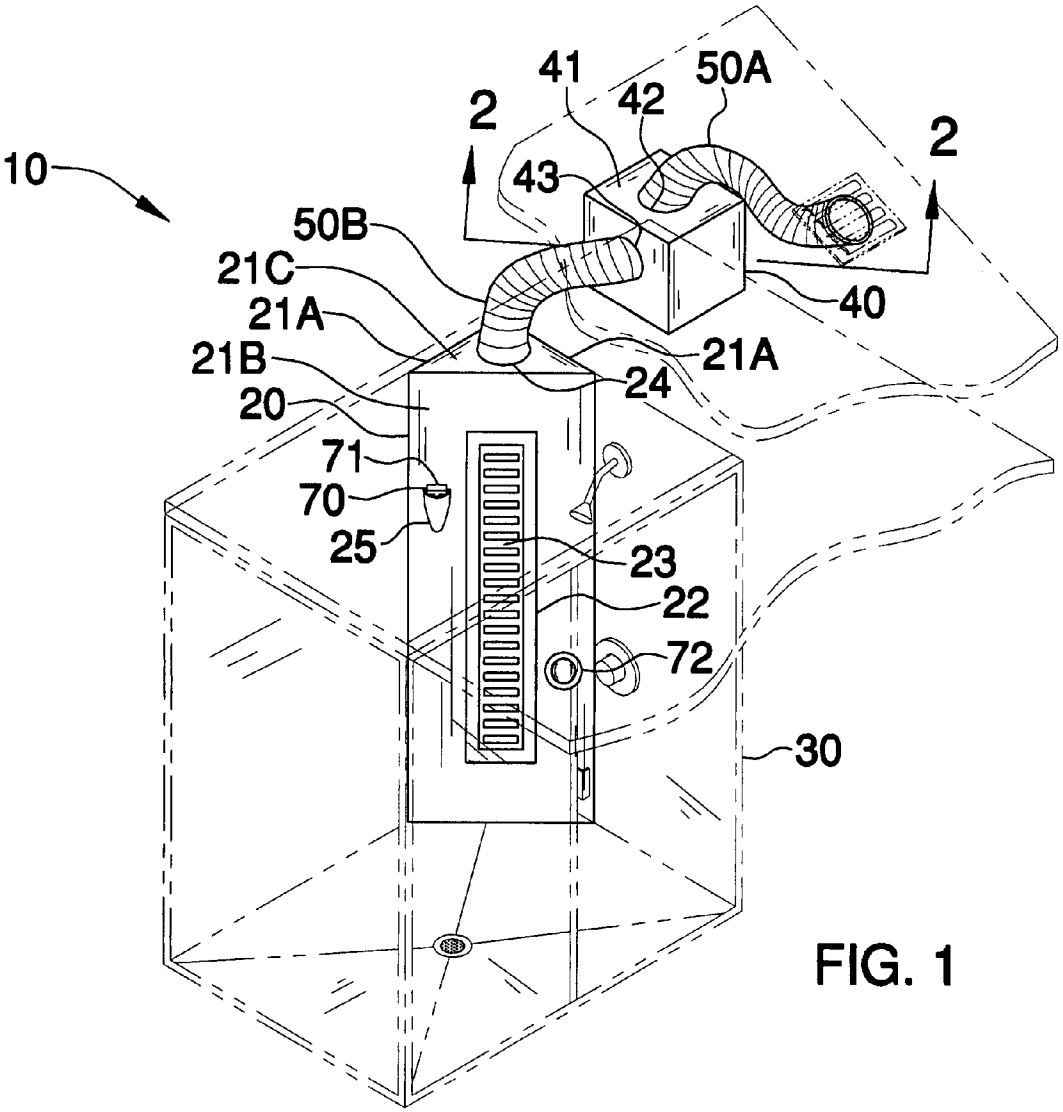
FIG. 1 is a perspective view showing a body drying apparatus for removing externally disposed fluids from a user's body, in accordance with the present invention.
Figure 2:
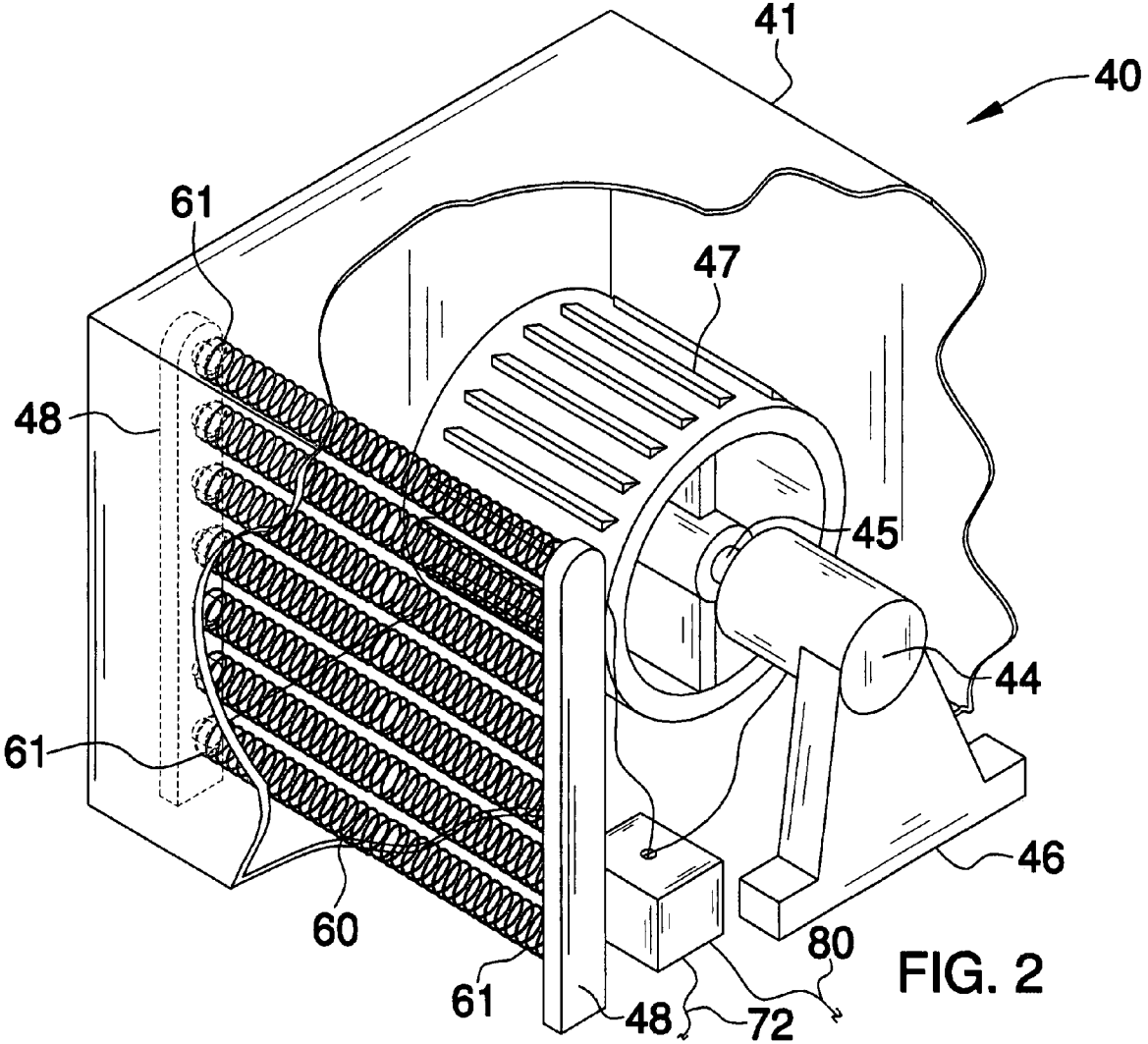
FIG. 2 is a partially exposed view of the power unit shown in FIG. 1.
Figure 3:
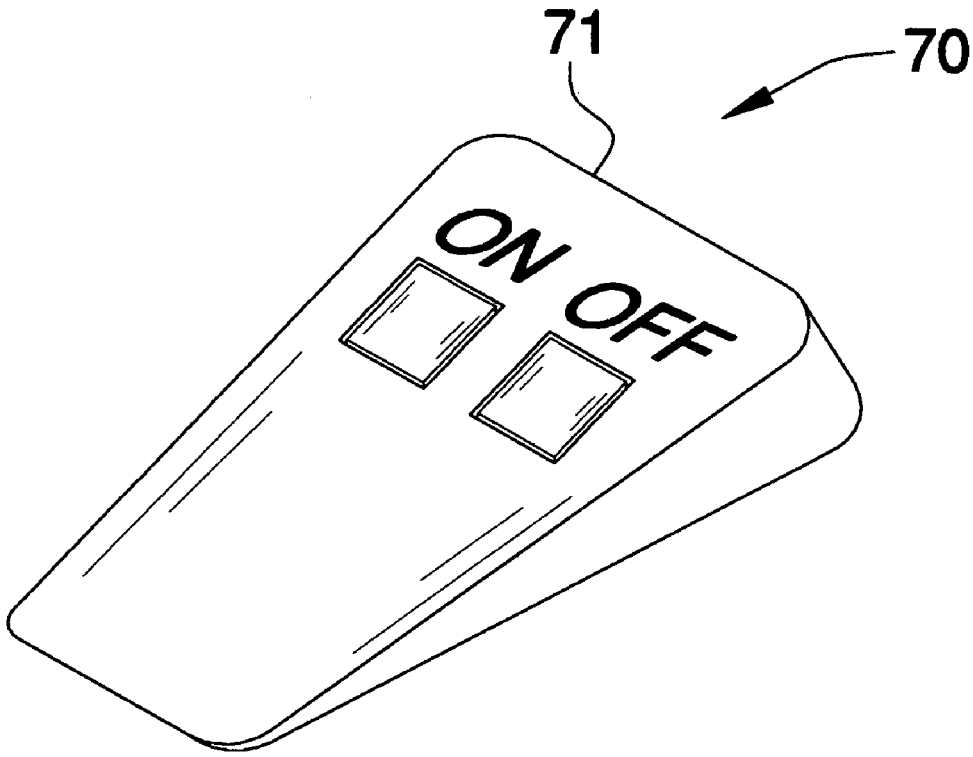
FIG. 3 is an enlarged perspective view of the remote operating mechanism shown in FIG. 1.

The apparatus of this invention is referred to generally in FIGS. 1–3 by the reference numeral 10 and is intended to provide a body drying apparatus. It should be understood that the apparatus 10 may be used to dry many people in many different types of situations and should not be limited to use in only a shower.

Referring initially to FIG. 1, the apparatus 10 includes a vertically oriented housing 20 for dissipating heated air outwardly therefrom and into a plenum 30 sized and shaped for containing a user therein. Such a housing 20 is situated within the plenum 30 and has at least one rear wall 21*a* abutted against an interior surface of the plenum 30. The housing 20 further has a front wall 21*b* including a vent 22 formed therein for effectively permeating the heated air into the plenum 30 during operating conditions and a top wall 21*c* provided with an opening 24 in fluid communication with the vent 22. Such a vent 22 extends along a longitudinal length of the front wall 21*b* and is provided with a grill 23 channeling the heated air in a selected direction. This feature of the apparatus 10 allows large areas of an individual's body to be dried at one time and more effectively than would be possible with a conventional bath towel.

Referring to FIGS. 1 and 2, a power unit 40 and a plurality of flexible conduits 50 direct ambient air into the power unit 40 and direct the heated air out from the power unit 40 into the housing 20 via the opening 24 respectively. Such a power unit 40 is electrically coupled to an external power supply source 80. The power unit 40 and the conduits 50 are positioned at an exterior of the plenum 30.

Still referring to FIGS. 1 and 2, the power unit 40 includes a casing 41 having an inlet 42 and outlet 43 oppositely formed therein. Such an inlet 42 is in fluid communication with one of the conduits 50*a* for effectively introducing the ambient air into the casing 41. The outlet 43 is in fluid communication with another one of the conduits 50*b* for advantageously dissipating the heated air away from the casing 41. The power unit 40 further includes a motor 44 including a drive shaft 45 extending outwardly therefrom. A support bracket 46 effectively maintains the motor 44 at a substantially stable position during operating conditions and an air blower 47 is operably connected to the drive shaft 45 and spaced medially of the inlet 42 and the outlet 43 respectively. Such a blower 47 is rotatable in sync with the drive shaft 45 for directing a selected volume of the ambient air towards the outlet 43.

Referring to FIG. 2, a plurality of heating elements 60 are positioned downstream of the blower 47 for advantageously converting the ambient air into heated air as the ambient air is passed therethrough. Such heating coils 60 are disposed adjacent to the outlet 43 such that the heated air can be effectively directed into the housing 20 via another conduit 50*b*. This feature advantageously allows an individual to be dried more rapidly and comfortably than would be the case if cold ambient air was expelled by the power unit 40. Of course, the heating feature may be turned off when cold air is preferred over warm air. The power unit 40 further includes a pair of spaced brackets 48 having a predetermined spatial relationship for vertically juxtaposing the heating coils 60. Such heating coils 60 have opposed end portions 61 positioned along a substantially horizontal axis and connected to the brackets 48.

Referring to FIGS. 1 and 3, a mechanism 70 is included for remotely operating the power unit 40 such that a user may conveniently toggle the apparatus 10 between on and off modes while situated in an aqueous environment adjacent to the housing 20. Such a remote operating mechanism 70 includes a portable hand-operable control panel 71 and a sensor 72 disposed within the housing 20 for receiving an operating signal generated by a user input at the control panel 71. The housing 20 further includes a pocket 25 for supporting the control panel 71 therein to thereby advantageously reduce the likelihood of misplacing the control panel 71 during non-operating conditions.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. An air-drying apparatus for removing externally disposed fluids from a user's body, said system comprising:

a housing for dissipating heated air outwardly therefrom and into a plenum sized and shaped for containing a user therein, said housing being situated within said plenum and having at least one rear wall abutted against an interior surface of the plenum, said housing further having a front wall comprising a vent formed therein for permeating the heated air into the plenum during operating conditions, said housing further having a top wall provided with an opening in fluid communication with said vent;

a power unit and a plurality of flexible conduits for directing ambient air into said power unit and for directing the heated air out from said power unit into said housing via the opening respectively, said power unit being electrically coupled to an external power supply source; and means for remotely operating said power unit such that a user may toggle said apparatus between on and off modes while situated in an aqueous environment and adjacent said housing.

2. The air-drying apparatus of claim 1, wherein said power unit comprises:

a casing having an inlet and outlet oppositely formed therein, said inlet being in fluid communication with one said conduits for introducing the ambient air into said casing, said outlet being in fluid communication with another said conduits for dissipating the heated air away from said casing;

a motor including a drive shaft extending outwardly therefrom;

a support bracket for maintaining said motor at a substantially stable position during operating conditions;

an air blower operably connected to said drive shaft and spaced medially of said inlet and said outlet respectively, said blower being rotatable in sync with said drive shaft for directing a selected volume of the ambient air towards said outlet; and a plurality of heating elements positioned downstream of said blower for converting the ambient air into the heated air as the ambient air is passed therethrough, said heating coils being disposed adjacent said outlet such that the heated air can be effectively directed into said housing via said another conduit.

3. The air-drying apparatus of claim 2, wherein said power unit further comprises: a pair of spaced brackets having a predetermined spatial relationship for vertically juxtaposing said heating coils, said heating coils having opposed end portions positioned along a substantially horizontal axis and connected to said brackets.

4. The air-drying apparatus of claim 1, wherein said remote operating means comprises:

a portable hand-operable control panel and a sensor disposed within said housing for receiving an operating signal generated by a user input at said control panel.

5. The air-drying apparatus of claim 1, wherein said housing further comprises: a pocket for supporting said control panel therein to thereby reduce the likelihood of misplacing said control panel during non-operating conditions.

6. An air-drying apparatus for removing externally disposed fluids from a user's body, said system comprising:

a vertically oriented housing for dissipating heated air outwardly therefrom and into a plenum sized and shaped for containing a user therein, said housing being situated within said plenum and having at least one rear wall abutted against an interior surface of the plenum, said housing further having a front wall comprising a vent formed therein for permeating the heated air into the plenum during operating conditions, said housing further having a top wall provided with an opening in fluid communication with said vent;

a power unit and a plurality of flexible conduits for directing ambient air into said power unit and for directing the heated air out from said power unit into said housing via the opening respectively, said power unit being electrically coupled to an external power supply source, said power unit and said conduits being positioned exterior of the plenum; and means for remotely operating said power unit such that a user may toggle said apparatus between on and off modes while situated in an aqueous environment and adjacent said housing.

7. The air-drying apparatus of claim 6, wherein said power unit comprises:

a casing having an inlet and outlet oppositely formed therein, said inlet being in fluid communication with one said conduits for introducing the ambient air into said casing, said outlet being in fluid communication with another said conduits for dissipating the heated air away from said casing;

a motor including a drive shaft extending outwardly therefrom;

a support bracket for maintaining said motor at a substantially stable position during operating conditions;

an air blower operably connected to said drive shaft and spaced medially of said inlet and said outlet respectively, said blower being rotatable in sync with said drive shaft for directing a selected volume of the ambient air towards said outlet; and a plurality of heating elements positioned downstream of said blower for converting the ambient air into the heated air as the ambient air is passed therethrough, said heating coils being disposed adjacent said outlet such that the heated air can be effectively directed into said housing via said another conduit.

8. The air-drying apparatus of claim 6, wherein said power unit further comprises: a pair of spaced brackets having a predetermined spatial relationship for vertically juxtaposing said heating coils, said heating coils having opposed end portions positioned along a substantially horizontal axis and connected to said brackets.

9. The air-drying apparatus of claim 6, wherein said remote operating means comprises:

a portable hand-operable control panel and a sensor disposed within said housing for receiving an operating signal generated by a user input at said control panel.

10. The air-drying apparatus of claim 6, wherein said housing further comprises: a pocket for supporting said control panel therein to thereby reduce the likelihood of misplacing said control panel during non-operating conditions.

11. An air-drying apparatus for removing externally disposed fluids from a user's body, said system comprising:

a vertically oriented housing for dissipating heated air outwardly therefrom and into a plenum sized and shaped for containing a user therein, said housing being situated within said plenum and having at least one rear wall abutted against an interior surface of the plenum, said housing further having a front wall comprising a vent formed therein for permeating the heated air into the plenum during operating conditions, said housing further having a top wall provided with an opening in fluid communication with said vent, said vent extending along a longitudinal length of said front wall and being provided with a grill channeling the heated air in a selected direction;

a power unit and a plurality of flexible conduits for directing ambient air into said power unit and for directing the heated air out from said power unit into said housing via the opening respectively, said power unit being electrically coupled to an external power supply source, said power unit and said conduits being positioned exterior of the plenum; and means for remotely operating said power unit such that a user may toggle said apparatus between on and off modes while situated in an aqueous environment and adjacent said housing.

12. The air-drying apparatus of claim 11, wherein said power unit comprises:

a casing having an inlet and outlet oppositely formed therein, said inlet being in fluid communication with one said conduits for introducing the ambient air into said casing, said outlet being in fluid communication with another said conduits for dissipating the heated air away from said casing;

a motor including a drive shaft extending outwardly therefrom;

a support bracket for maintaining said motor at a substantially stable position during operating conditions;

an air blower operably connected to said drive shaft and spaced medially of said inlet and said outlet respectively, said blower being rotatable in sync with said drive shaft for directing a selected volume of the ambient air towards said outlet; and a plurality of heating elements positioned downstream of said blower for converting the ambient air into the heated air as the ambient air is passed therethrough, said heating coils being disposed adjacent said outlet such that the heated air can be effectively directed into said housing via said another conduit.

13. The air-drying apparatus of claim 11, wherein said power unit further comprises: a pair of spaced brackets having a predetermined spatial relationship for vertically juxtaposing said heating coils, said heating coils having opposed end portions positioned along a substantially horizontal axis and connected to said brackets.

14. The air-drying apparatus of claim 11, wherein said remote operating means comprises:

a portable hand-operable control panel and a sensor disposed within said housing for receiving an operating signal generated by a user input at said control panel.

15. The air-drying apparatus of claim 11, wherein said housing further comprises: a pocket for supporting said control panel therein to thereby reduce the likelihood of misplacing said control panel during non-operating conditions.

* * * * *